United States Patent [19]

Pialet

[11] Patent Number: 4,943,303

[45] Date of Patent: Jul. 24, 1990

[54] CETANE IMPROVER

[75] Inventor: Joseph W. Pialet, Euclid, Ohio

[73] Assignee: The Lubrizol Corporation, Wickliffe, Ohio

[21] Appl. No.: 801,528

[22] Filed: Nov. 25, 1985

[51] Int. Cl.[5] ..... C10L 1/10

[52] U.S. Cl. ..... 44/57; 44/76

[58] Field of Search ..... 44/57, 76

[56] References Cited

U.S. PATENT DOCUMENTS

| | | | |
|---|---|---|---|
| 2,034,643 | 3/1936 | Taveau | 44/9 |
| 2,167,345 | 7/1939 | Crandall et al. | 44/9 |
| 2,226,298 | 12/1940 | Wellman | 44/9 |
| 2,263,234 | 11/1941 | Cloud | 44/9 |
| 2,268,382 | 12/1941 | Cloud | 44/9 |
| 2,326,102 | 8/1943 | Nygaard et al. | 44/57 |
| 2,493,284 | 1/1950 | Farkas | 44/57 |
| 2,560,421 | 7/1951 | Eby | 260/608 |
| 2,580,695 | 1/1952 | Niederhauser | 260/601 |
| 2,614,914 | 10/1952 | Eby | 44/57 |
| 2,662,086 | 4/1948 | Hughes et al. | 260/327 |
| 2,794,049 | 5/1957 | Thompson | 260/586 |
| 2,877,749 | 3/1959 | Fox | 123/1 |
| 3,004,981 | 10/1961 | Asinger et al. | 260/306.7 |
| 3,296,137 | 1/1967 | Wiese | 252/48.2 |
| 3,380,815 | 4/1968 | Herbst | 44/57 |
| 4,398,505 | 8/1983 | Cahill | 123/1 A |

OTHER PUBLICATIONS

"Means of improving Ignition Quality of Diesel Fuels" by Nygarrd et al., J. Inst. Petroleum, 27, 348–368, (1941).

"Preflame Reactions in Diesel Engines", Part 1, by Gardner et al., The Institute of Petroleum, vol. 38, 341, May 1952.

"Ignition Accelerators for Compression–Ignition Fuels" by Bogen et al., Petroleum Refiner, 23(7), 118–52, (1944).

*Primary Examiner*—Margaret B. Medley

*Attorney, Agent, or Firm*—Robert A. Franks; Frederick D. Hunter; Forrest L. Collins

[57] ABSTRACT

A cetane improver for diesel fuels is a sulfur containing compound having at least one electron withdrawing group therein. The electron withdrawing group desirably is a carbonyl group.

13 Claims, No Drawings

CETANE IMPROVER

BACKGROUND OF THE INVENTION

The present invention relates to a sulfur containing compound having as an activating moiety at least one electron withdrawing group therein such as a carbonyl functional group.

Heretofore, numerous compounds have been utilized as cetane improvers with various alkyl nitrates often being utilized on a commercial basis.

U.S. Pat. No. 2,034,643 to Taveau generally relates to dialkyl or diaryl substituted symmetrical or unsymmetrical tetrasulfides.

U.S. Pat. No. 2,167,345 to Crandall et al relates to organic disulphides such as alkyl disulphides and diaryl disulphides as cetane improvers.

U.S. Pat. No. 2,263,234 to Cloud relates to organic trisulfides as cetane improvers.

U.S. Pat. No. 2,268,382 to Cloud et al relates to ignition promotors for diesel fuels characterized by organic compounds containing a thiocarboxylic acid radical.

U.S. Pat. No. 2,326,102 to Nygaard et al relates to diesel fuels of improved emission quality by mixing the fuel with a minor proportion of the reaction product obtained by reacting perchloromethylmercaptan with a compound of the general formula $R(XH)_n$ or $R(XM)_n$ where R represents an alkyl, aryl, alkaryl, or aralkyl radical and X is oxygen or sulfur and M represents the hydrogen equivalent of a metal and n is a whole number.

U.S. Pat. No. 2,560,421 to Eby relates to halogenated tertiary alkyl sulfides and polysulfides which can be used as insecticides, fungicides, and the like.

U.S. Pat. No. 2,580,695 to Niederhauser relates to dialdehydes containing disulfide groups which compounds are useful as cross-linking agents and as chemical intermediates.

U.S. Pat. No. 2,614,914 to Eby relates to an additive for improving the properties of lubricating oils and diesel fuels wherein the additive is a dialkyl sulfide having tertiary alkyl radicals of at least 8 carbon atoms in each alkyl group with such alkyl groups being connected by at least 2 sulfur atoms.

U.S. Pat. No. 2,662,086 to Hughes et al relates to a process of hydrolyzing dichlorodipropyl sulfide, or reaction mixtures containing dichlorodipropyl sulfide resulting from the reaction of propylene and sulfur monochloride to form (1) dimethyl thioxane and (2) a hydrolytic condensation product in the form of an oil like polymer.

U.S. Pat. No. 2,794,049 to Thompson relates to compounds containing certain dithia-diketones in which the keto and sulfur groups are in a specific relation to each other.

U.S. Pat. No. 3,004,981 to Asinger et al relates to a process for preparing delta-3,4-thiazolines by reacting a mixture of an alpha-diketodisulfide with an oxo compound, for example, an aldehyde or ketone, at room temperature with $H_2S$ and $NH_3$.

U.S. Pat. No, 3,296,137 to Wiese relates to lubricants containing aldehydohydrocarbon sulfides.

SUMMARY OF THE INVENTION

It is, therefore, an aspect of the present invention to provide a cetane improver which can be readily made.

It is another aspect of the present invention to provide a cetane improver, as above, wherein said cetane improver is a sulfur containing compound having at least one electron withdrawing group.

In general, a cetane improver comprises a sulfur containing compound having the formula

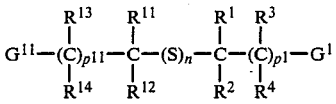

wherein n is an integer from to about 8; wherein $p^1$ and $p^{11}$ independently, is an integer of from 0 to 2; wherein $R^3$, $R^{13}$, $R^4$, and $R^{14}$, independently, is H or an alkyl having from 1 to 6 carbon atoms; wherein $R^2$ and $R^{12}$, independently, is H or a hydrocarbyl having from 1 to about 18 carbon atoms; wherein $G^1$ and $G^{11}$ is independently an electron withdrawing group such as C≡N, $NO_2$,

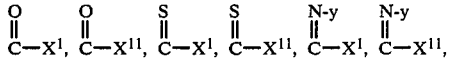

$S(O)_zX^1$, or $S(O)_zX^{11}$; wherein $X^1$ and $X^{11}$, independently, is H, lower alkyl, OH, OR* where R* is an alkyl having from 1 to 22 carbon atoms,

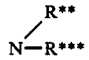

where R and R* is, independently, H or an alkyl having from 1 to 20 carbon atoms; where y is H, a hydrocarbyl having from 1 to about 18 carbon atoms, OH, OR* or

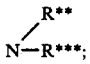

wherein z is 1 or 2; wherein $R^1$ and $R^{11}$, independently is H, or a hydrocarbyl having from 1 to 18 carbon atoms or said $G^1$; and optionally wherein $R^1$ and $R^3$, $R^2$ and $R^4$, $R^{11}$ and $R^{13}$, or $R^{12}$ and $R^{14}$, are bonded together, and independently, form a hydrocarbyl substituent, having a total of from 1 to 18 carbon atoms.

It is a specific aspect of the present invention to provide a cetane improver which is a sulfur containing hydrocarbon having the formula

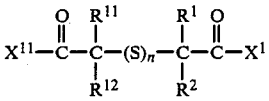

wherein n is an integer of from 1 to about 8; wherein $R^2$ and $R^{12}$, independently, is H or a hydrocarbyl having from 1 to 18 carbon atoms; wherein $X^1$ and $X^{11}$, independently, is H, an alkyl having from 1 to about 20 carbon atoms, OH, OR* where R* is an alkyl having from 1 to about 22 carbon atoms, or

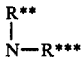

where R and R*, is, independently, H, or an alkyl having from about 1 to about 20 carbon atoms; and wherein $R^1$ and $R^{11}$, independently, is H, a hydrocarbyl having from to 18 carbon atoms or said $$\overset{O}{\overset{\|}{C}}-X^1.$$

DESCRIPTION OF THE INVENTION

Sulfur containing compounds of the present invention having at least one electron withdrawing group therein function as cetane improvers. A cetane improver is a compound which increases the cetane number of a diesel fuel. Diesel engines are distinguished from gasoline engines in that they operate on a different principle. In gasoline engines, the fuel is drawn into the cylinder, compressed, and ignited by a spark plug. The fuel must be able to resist ignition by the heat of compression to prevent knocking. This resistance to ignition is measured by the octane number, with aromatics and highly branched aliphatics having higher octane numbers than straight chain aliphatics. In diesel engines, the situation is reversed. The fuel is injected into the cylinder during compression and must be ignited by the heat of compression. The ease of ignition is measured by the cetane number with straight chain aliphatics having higher cetane numbers than branched aliphatics and aromatics. Because of these differences, octane numbers and cetane numbers tend to be inversely proportional to one another. Generally, the most accurate measure of ignition quality in a diesel engine is the cetane number as described and defined in A.S.T.M. D 613. This test uses a single cylinder diesel engine with an adjustable compression ratio. The timing is set to start injection of the fuel at 13° before top dead center at 900 rpm. The compression ratio is adjusted to initiate combustion at top dead center and the fuel is then bracketed with reference fuels requiring approximately the same compression ratio. The primary reference fuels are mixtures of n-hexadecane (cetane) with a defined cetane number of 100 and heptamethyl nonane with a cetane number of 15 or 1-methyl naphthalene with a cetane number of 0.

The electron withdrawing group of the cetane improver compounds of the present invention is generally an activating moiety such as a carbonyl functional group, for example, an aldehyde, an acid, an ester, an amide, a ketone; a thiocarbonyl functional group, a nitrile functional group, a nitro functional group, a sulfone functional group, a sulfoxide functional group, and combinations thereof. Generally, the sulfur containing compound has two such groups therein. Of these various functional groups, carbonyl is preferred. Thus, the above-noted functional groups generally act as electron withdrawing groups.

Cetane improvers according to the present invention generally have the following formula wherein any of the above-noted groups can replace the carbonyl groups:

$$G^{11}-\underset{\underset{R^{14}}{|}}{(C)_{p11}}-\underset{\underset{R^{12}}{|}}{\overset{R^{13}}{\overset{|}{C}}}-(S)_n-\underset{\underset{R^2}{|}}{\overset{R^1}{\overset{|}{C}}}-\underset{\underset{R^4}{|}}{(C)_{p1}}-G^1$$

The number of sulfur atoms, that is n, is generally from 1 to 8, desirably from 1 to 5, and preferably from 2 to 4 or more preferably 2 or 3 The number of $p^1$ and $p^{11}$ groups is from 0 to 2 with 0 being preferred. That is, when $p^1$ and/or $p^{11}$ are 0, the $R^3$, $R^4$, $R^{13}$ and $R^{14}$ groups do not exist. $R^3$, $R^{13}$, $R^4$ and $R^{14}$, independently, is H, or an alkyl group having from 1 to 6 carbon atoms, such as methyl, ethyl, propyl or isopropyl, butyl, isobutyl, pentyl, hexyl, and the various isomers thereof. Hydrogen or methyl are desirable with hydrogen being preferred when $p^1$ and $p^{11}$ independently is 1 or 2. $R^2$ and $R^{12}$ are, independently, a hydrocarbyl having from 1 to 18 carbon atoms or hydrogen. More specifically, the hydrocarbyl is an aliphatic, and preferably an alkyl. The number of carbon atoms in such groups desirably is from 1 to 8, preferably 1 or 2, with 1 carbon atom being preferred. Thus, in the most preferred embodiment, $R^2$ and $R^{12}$ are methyl. $G^1$ and $G^{11}$, independently, is an electron withdrawing group such as C≡N, $NO_2$, $$\overset{O}{\overset{\|}{C}}-X^1,\ \overset{O}{\overset{\|}{C}}-X^{11},\ \overset{S}{\overset{\|}{C}}-X^1,\ \overset{S}{\overset{\|}{C}}-X^{11},\ \overset{N\text{-}y}{\overset{\|}{C}}-X^1,\ \overset{N\text{-}y}{\overset{\|}{C}}-X^{11},$$

$S(O)_zX^1$ or $S(O)_zX^{11}$ where y is H, a hydrocarbyl having from 1 to 18 carbon atoms, OH, OR* or $$N\begin{matrix}-R^{}\\-R^{*};\end{matrix}$$

and wherein z is 1 or 2.

As used herein and throughout this specification, the term "hydrocarbyl-based substituent" or "hydrocarbyl" denotes a substituent having carbon atoms directly attached to the remainder of the molecule and having predominantly hydrocarbyl character within the context of this invention. Such substituents include the following: (1) hydrocarbon substituents, that is aliphatic (for example alkyl or alkenyl), alicyclic (for example cycloalkyl or cycloalkenyl) substituents, armoatic-, aliphatic- and alicyclic-substituted aromatic nuclei and the like, as well as cyclic substituents wherein the ring is completed through another portion of the molecule (that is, any two indicated substituents may together form an alicyclic radical). (2) substituted hydrocarbon substituents, that is, those containing non-hydrocarbon radicals which, in the context of this invention, do not alter the predominantly hydrocarbyl character of the substituent. Those skilled in the art will be aware of suitable radicals (e.g., halo, (especially chloro and fluoro), alkoxyl, mercapto, alkylmercapto, nitro, nitroso, sulfoxy, etc.). (3) Hereto substituents, that is substituents which, while predominantly hydrocarbon in character within the context of this invention, contain atoms other than carbon present in a chain or ring otherwise composed of carbon atoms.

$R^1$ and $R^{11}$, independently, can be hydrogen, $G^1$, or a hydrocarbyl having from 1 to 18 carbon atoms, desirably from 1 to 8 carbon atoms, preferably 1 or 2 carbon atoms with one carbon atom being preferred. More specifically, the hydrocarbyl is an aliphatic with an alkyl being preferred. Considering $X^1$ and $X^{11}$ of $G^1$, they are various radicals such as in association with a carbonyl group, specific end groups are formed. Accordingly, $X^1$ and $X^{11}$, independently, can be hydrogen such that an aldehyde end group is formed; a lower alkyl having from about 1 to about 22 carbon atoms and desirably from about 1 to about 18 carbon atoms such that a ketone is formed; a hydroxyl such that a carboxylic acid is formed; an -OR* where R* is an alkyl having from about 1 to about 22 carbon atoms and preferably from 1 to 10 carbon atoms such that an ester is formed; or

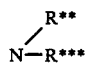

where R and R* are, independently, hydrogen, an alkyl having from 1 to 20 carbon atoms or more desirably an alkyl having from 1 to 10 carbon atoms such that an amide is formed. Of the various $X^1$ and $X^{11}$ groups, hydrogen, that is an aldehyde end group, and OR*, that is an ester end group, are preferred.

As an optional aspect of the above formulation, independently, $R^1$ and $R^3$, $R^2$ and $R^4$, $R^{11}$ and $R^{13}$, $R^{12}$ and $R^{14}$ can be directly bonded to one another. In such a situation, the various bonded groups, e.g., $R^1$ and $R^3$, are a hydrocarbyl substituent having a total of from 1 to about 18 carbon atoms wherein the term "hydrocarbyl substituent" is as defined hereinabove. In such a situation, a cyclic compound is formed which can contain substituted hydrocarbons thereon, as well as the carbonyl-$X^1$ or carbonyl-$X^{11}$ groups thereon. An example of such a specific compound is butyl cyclohexenecarboxylate. Typically, the various adjacent groups such as $R^1$ and $R^3$ are not bonded together. A preferred cetane improver includes the product of Example 1.

Compounds containing a carbonyl group as set forth in the above formula are preferred. Moreover, the compounds utilized as cetane improvers should be soluble in the fuel. By soluble it is meant that generally the cetane improver does not precipitate out of the final blend or is dispersible, that is, remains in solution at temperatures above the solidification temperature of the fuel.

The sulfur containing compounds of the present invention are generally made by reacting a halogenated sulfur compound given by the general formula Cl—$S_n$—Cl wherein n=1 to 8 with 1 to 4 being preferred such as sulfur monochloride, sulfur dichloride or dichloropolysulfide, with an organic compound as set forth by the nonsulfur portion of the above formula as, for example, isobutyraldehyde, or the like. For purposes of brevity, the nonsulfur portion of the above formula will be referred to as an aldehyde portion wherein $X^1$ and $X^{11}$ are hydrogen, although it is to be understood that they can be various other groups as set forth hereinabove. The reaction between the sulfur compound and the aldehyde is exothermic. Thus, heat is only initially applied to the reaction mixture and the aldehyde compound slowly is added, for example, dropwise, thereto. Since the reaction is exothermic, excessive heat can be generated. Accordingly, the reaction time is dependent upon maintaining a suitable reaction temperature range such that overheating is avoided. Suitable reaction temperatures are from about ambient to the boiling point of the reactants. Naturally, such boiling points will vary with the particular compound as, for example, approximately 60° C. for isobutyraldehyde and approximately 138° C. for sulfur monochloride. A more desirable temperature range is from about 30° to about 100° C. When the reactants are isobutyraldehyde and sulfur monochloride, a preferred reaction temperature is from about 50° C. to about 60° C.

The reaction is generally carried out in a solvent-free environment. That is, inasmuch as the aldehyde or other type components are usually liquid and inasmuch as the sulfur component is usually liquid, no solvent is required. If solvents are used, they should be inert with regard to the aldehyde or other type component as well as with regard to the sulfur-type component. Suitable solvents include various halogenated hydrocarbons such as carbon tetrachloride, chloroform, methylene chloride, ethylene chloride, ethylene bromide, and the like. Also, the various alkanes can be used such as heptane, octane, hexane, nonane, decane, mineral oil, and the like as well as the various isomers thereof. Examples of various aromatics include benzene, toluene, and the like. In order to prevent oxidation of the aldehyde or other type compound, the reaction generally takes place in the presence of an inert atmosphere such as nitrogen, argon, and the like. The nitrogen atmosphere is typically swept through the reaction and thereby removes generated hydrogen chloride. The reaction is generally carried out at atmospheric pressure although slight pressures can be utilized as from about 14 psig to about 1,400 psig.

An equivalent amount of reactants is utilized, such as from about 0.2 moles to about 5.0 moles and desirably from about 0.8 moles to about 2.5 moles of the aldehyde component to the sulfur component. However, it is to be understood that greater or lesser amounts can also be utilized. In the preferred embodiment, 2 moles of the aldehyde compound is utilized with regard to 1 mole of sulfur compound. If an excessive amount of the aldehyde compound is utilized, it generally is swept out by the sweep gas. If an excessive amount of the sulfur compound is utilized, it is generally somewhat difficult to remove. Thus, a slight excess of the aldehyde compound is preferred over a slight excess of the sulfur compound.

The various cetane improvers according to the present invention are utilized in diesel fuels. Diesel fuels can be defined broadly as a fuel having a suitable boiling range and viscosity for use as a fuel in a diesel-type engine. Fuels containing alcohols and esters are also included within the definition of a diesel fuel. The boiling range of the diesel fuel can vary as from about an A.S.T.M. boiling range of from about 120° C. to about 425° C., more desirably from about 140° C. to about 400° C. and oftentimes from about 200° C. to about 370° C. Generally, diesel fuels fall into grades 1D, 2D, and 4D, and usually have viscosities of from about 1.3 to about 24.0 centistokes at 40° C.

It is an aspect of the present invention to also utilize various alcohols and esters as partial replacement for diesel fuels and even as the total replacement therefore. The alcohols are generally hydrocarbon-based alcohols such as aliphatic, for example, alkyl, aromatic, or combinations thereof. The alcohols are alkyl alcohols having from about 1 to about 50 and desirably from about 1 to about 22 carbon atoms. The esters can generally be any esters known to the art or to the literature which can be burned in a diesel engine. Thus, esters derived from synthetic as well as natural sources such as soya bean oil, lard oil, cottonseed oil, sunflower oil, various animal fats and the like are often utilized. Triglycerides are also within the scope of the present invention wherein the various chains can all be the same, mixed, branched, and the like. Esters of acids of from about 10 carbon atoms to about 22 carbon atoms, such as palmitic acid, stearic acid, oleic acid, linoleic acid, linolenic acid, and the like can be utilized. Normally, the diesel fuels are derived from a petroleum feedstock. However, it is to be understood that it is within the scope of the present invention that fuels derived from the pyrolysis or hydrogenation of coal or other feedstocks can also be utilized.

The various diesel fuels typically contain various additives in conventional amounts. The additives include cold flow improvers, pour point depressants, storage stabilizers, corrosion inhibitors, anti-static agents, biocidal additives, combustion modifiers or smoke suppressants, dyes, and deodorants. Examples of such additives are known to the art as well as to the literature. Accordingly, only a few additives will be discussed in detail. Considering the storage stabilizers, they can include various antioxidants which prevent the accumulation of organic peroxides such as hindered phenols, N,N,-dialkyl paraphenylene diamines, paraamino phenols and the like. Color stabilizers constitute another group with specific examples including tertiary amines, secondary amines, imidazolines, tertiary alkyl primary amines, and the like. Another storage stabilizer group are the various metal deactivators for metals which serve as catalysts for oxidation during storage. Yet other storage stabilizers are the various dispersants which keep gummy, insoluble residues and other solids dispersed as small particles so that they do not interfere with the proper burning of the fuel. Such compounds can be oil soluble ethoxylated alkyl phenols, polyisobutylene alkylated succinimides, polyglycol esters of alkylated succinic anhydrides, and the like.

Considering the corrosion inhibitors which generally retard the effects of oxygen and/or water, they are generally polar organic molecules which form a monomolecular protective layer over metal surfaces. Chemically, such corrosion inhibitors fall into three general classes: (1) complex carboxylic acids or their salts, (2) organic phosphorus acids and their salts, and (3) ammonium mahogany sulfonates.

Combustion modifiers for diesel fuel have been found to suppress the formation of black smoke, that is, unburned carbon particles, in the diesel engine. These additives are believed to not only catalyze the burning of carbon particles to $CO_2$, but also to suppress the formation of free carbon in the early stages of the combustion cycle. Generally, two different types of chemicals are effective in suppressing diesel smoke. The first type comprises barium and calcium salts in amine or sulfonate complexes while the other type consists of metal alkyls of transition elements such as manganese, iron, cobalt, nickel, and the like.

As noted above, amounts of the various fuel additives in the fuel can vary over a considerable range. Generally, a suitable amount of a diesel fuel stabilizer is from about 3 to about 300 ppm. A suitable amount of a corrosion inhibitor is from about 1 to about 100 ppm with a suitable amount of a smoke suppressant being from about 100 to about 5,000 ppm. Naturally, higher or lower amounts can be utilized depending upon the type of fuel, the type of diesel engine, and the like.

The amount of the cetane improver of the present invention is such that when added to said diesel fuel, the total weight of sulfur is from about 0.001% to about 5% by weight based upon a total weight of said diesel fuel. That is, inasmuch as some sulfur does exist in most diesel fuels, the amount of sulfur contained in the cetane improver is the difference such that the total amount of sulfur in the fuel is in the above-noted range. A more desirable range is from about 0.01% to about 3% by weight with from about 0.05% to about 2% by weight being preferred. The cetane improver can also be utilized as a concentrate in association with one or more diesel fuel additives. Generally, the amount of cetane improver in the concentrate is from about 10% to about 99% by weight and more desirably from about 25% to about 99% by weight based upon the total weight of the concentrate.

It is another aspect of the present invention to utilize other cetane improvers such as sulfur-free cetane improvers with the sulfur cetane improvers of the present invention. Desirably, the sulfur-free compounds are nitrate cetane improvers which are known to the art as well as to the literature. For example, a description of such nitrate cetane improvers are set forth in U.S. Pat. Nos. 2,493,284; 4,398,505; 2,226,298; 2,877,749; 3,380,815; an article "Means of Improving Ignition Quality of Diesel Fuels" by Nygarrd et al, J. Inst. Petroleum, 27, 348–368 (1941); an article "Preflame Reactions in Diesel Engines", Part 1, by Gardner et al, The Institute of Petroleum, Vol. 38, 341, May, 1952; and an article "Ignition Accelerators for Compression-Ignition Fuels" by Bogen et al, Petroleum Refiner 23, (7) 118–52 (1944), which are hereby fully incorporated by reference with regard to various types of nitrate cetane improvers. Generally, the cetane improvers are alkyl nitrates having from about 1 to about 18 carbon atoms and desirably from about 2 to about 13 carbon atoms. Examples of specific nitrate cetane improvers include ethyl nitrate, butyl nitrate, amyl nitrate, 2-ethylhexyl nitrate, polyglycol dinitrate, and the like. Amyl nitrate and 2-ethylhexyl nitrate are preferred. The amount of the nitrate cetane improver which can be utilized in association with the sulfur-containing cetane improver of the present invention generally ranges from about 0.1 to about 10 parts by weight per part by weight of sulfur-containing cetane improver of the present invention and more desirable from about 0.25 to about 4.0 parts by weight.

It has been found that oftentimes synergistic results are achieved with regard to cetane improvement when a nitrate cetane improver is utilized in association with the cetane improvers of the present invention. For example, synergistic results are obtained when 2-ethylhexyl nitrate is utilized in association with Example 1.

The sulfur-containing cetane improver of the present invention yield a good cetane improvement as noted in the examples set forth hereinbelow and is relatively inexpensive to produce.

The present invention will be better understood by reference to the following examples wherein the amount of cetane improvement is set forth in cetane units.

EXAMPLE 1

Sulfur monochloride in an amount of 2,025 grams was added to a five liter flask and warmed under nitrogen to approximately 50° C. An amount of 2,163 grams of isobutyraldehyde was added dropwise over a five and one-half hour period maintaining the reaction temperature at approximately 50°–60° C. After addition was completed, the flask was slowly heated to 100° C. and held for three hours (NNAbpb about 0.7). Nitrogen was blown through the flask at about approximately 100° C. for several hours. The reaction product was then filtered. The desired reaction product, predominantly 2,2'-dithiodiisobutyraldehyde, was recovered in 95% yield.

The cetane improvement of the compound produced in Example 1 was determined in Fuel #1 (42 cetane number) as well as in Fuel #2 (33 cetane number). The cetane test was made in accordance with A.S.T.M. Test D 976. The cetane improvement over the base fuel is set forth in Table 1.

TABLE 1

| % Treat | Cetane Improvement Fuel #1 | Fuel #2 |
|---|---|---|
| 0.1 | 3.7 | 3.4 |
| 0.2 | 5.0 | 5.6 |
| 0.3 | 6.1 | 7.0 |

As apparent from Table 1, rather significant improvements in the cetane levels were obtained especially at 0.2% and at 0.3% treat level.

EXAMPLE 2

Sulfur monochloride was charged to a two liter flask in an amount of 405 grams and warmed to 50° C. under nitrogen. 2-ethylhexanal was added dropwise. After 45 minutes, the reaction materials exothermed to about 65°. Addition of the remaining aldehyde (a total of 769.2 grams) was continued at approximately 55° for a period of approximately five hours (NNAbpb about 9.8). The reaction was then slowly heated to 100° C. and held for several hours with NNA leveling out at about 3. 20 milliliters of additional aldehyde was added and heating was continued at 100° C. with a nitrogen sparge (NNAbpb about 0.86). The flask was stripped at 135° C. at 10 mm Hg and filtered. The desired product was obtained in 94.6% yield.

The cetane improver obtained from Example 2 was tested according to A.S.T.M. Test D 976 in Fuel #1 and yielded a cetane improvement of 6.4 at a treat level of 0.3% by weight.

EXAMPLE 3

Sulfur monochloride in the amount of 270 grams and sulfur in the amount of 64 grams were charged to a one liter flask and heated to 100° C. for three hours. The material was then cooled to 50° C. whereupon 288.4 grams of isobutyraldehyde was added dropwise under a nitrogen purge at approximately 50° to 57° C.

The contents of the flask were then heated to 100° C. and held for one day under a nitrogen purge. The material was filtered and the desired product was obtained in 76% yield. When the cetane improver was tested in Fuel #1 at 0.3%, a cetane improvement of 5.5 was obtained according to A.S.T.M. Test D 976.

EXAMPLE 4

In a flask 23 grams of sodium was dissolved in 500 ml. of methanol. The mixture was chilled in an ice bath and 89.10 grams of 1-nitropropane was added dropwise. The mixture was filtered and the solids were thoroughly washed with ether. The solids were then transferred to another vessel, suspended in ether and chilled to 0°-5° C. To the suspension 67.5 grams of sulfur monochloride was added dropwise over a period of ¾ hour. The mixture was filtered and the ether layer was washed with ice water and dried over $MgSO_4$. The ether was evaporated and the desired product was obtained. When the cetane improver was tested in Fuel #1 at 0.3%, a cetane improvement of 5.3 was obtained according to A.S.T.M. Test D 976.

EXAMPLE 5

Butyl cyclohexenecarboxylate was reacted with sulfur on a 1 to 2 mole basis according to the method described in Reissue Pat. No. 27,331. The desired product was obtained. When the cetane improver was tested in Fuel #1 at 0.3%, a cetane improvement of 3.8 was obtained according to A.S.T.M. Test D 976.

EXAMPLE 6

Another cetane improver was prepared as in Example 5 except that butyl acrylate was utilized and reacted with sulfur on a 1 to 1.5 mole basis. The desired product was obtained. When the cetane improver was tested at 0.3% in a 50/50% mixture of Fuel #1 and Fuel #2, a cetane improvement of 3.5 was obtained according to A.S.T.M. Test D 976.

EXAMPLE 7

Another cetane improver was prepared in a manner similar to Example 5 except that butyl methacrylate was reacted with sulfur in an amount of 1 mole of the ester to 2 moles of sulfur. When tested in accordance with A.S.T.M. Test D 976 in a 50/50% mixture of Fuel #1 and Fuel #2, a cetane improvement of 2.4 was obtained at a 0.3% treat level.

EXAMPLE 8

Blends of 2-ethylhexyl nitrate and the reaction product of Example 1 were made and tested with regard to the cetane number in accordance with A.S.T.M. Test D 976. The results are set forth in Table 2.

TABLE 2

| Identification | Level, % Wt. | Cetane No. | Delta Cetane No. |
|---|---|---|---|
| [nitrate + [i-butyraldehyde/ $S_2Cl_2$(2:1)m] (80:20)w] | 0.20 | 47.7 | 4.0 |
| [nitrate + [i-butyraldehyde/ $S_2Cl_2$(2:2m] (65:35w] | 0.20 | 48.9 | 5.2 |
| [nitrate + [i-butyraldehyde/ $S_2Cl_2$(2:1m] (50:50w] | 0.20 | 50.0 | 6.3 |
| [nitrate + [i-butyraldehyde/ $S_2Cl_2$(2:1m] (35:65)w] | 0.20 | 49.4 | 5.7 |
| [nitrate + [i-butyraldehyde/ $S_2Cl_2$(2:1m] (20:80)w] | 0.20 | 49.5 | 5.8 |

As apparent from Table 2, the blend of the nitrate cetane improver with the cetane improver of the present invention resulted in a significant increase in cetane number. Generally, a synergistic improvement was noted in a weight range of approximately 20% to about 80% by weight of utilization of a nitrate compound.

While in accordance with the patent statutes, a best mode and preferred embodiment has been presented, the scope of the invention is not limited thereto, but rather by the scope of the attached claims.

What is claimed is:

1. A composition comprising a hydrocarbon diesel fuel and an ignition promoting amount of a sulfur containing compound having the formula:

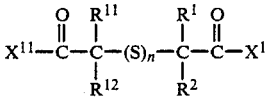

wherein n is an integer from 1 to about 8; wherein $R^2$ and $R^{12}$, independently, are H or a hydrocarbyl having from 1 to 18 carbon atoms; wherein $X^1$ and $X^{11}$, independently, are H, an alkyl having from 1 to 20 carbon atoms, OH, OR* where R* is an alkyl having from 1 to about 22 carbon atoms, or $$\begin{array}{c} R^{} \\ | \\ N-R^{*} \end{array}$$

where R and R*, are, independently, H or an alkyl having from 1 to about 20 carbon atoms; and wherein $R^1$ and $R^{11}$, independently, are H, a hydrocarbyl having from 1 to about 18 carbon atoms or $$\overset{O}{\overset{\|}{C}}-X^1.$$

2. The composition defined in claim 1, wherein n is 1 to 5; wherein $R^2$ and $R^{12}$ are hydrogen, methyl or ethyl; wherein $X^1$ and $X^{11}$, independently, are H, OR* where R* is an alkyl having from 1 to about 10 carbon atoms, or OH; and wherein $R^1$ and $R^{11}$, independently, are hydrogen, a saturated hydrocarbyl having from 1 to 8 carbon atoms, or $$\overset{O}{\overset{\|}{C}}-X^1.$$

3. The composition defined in claim 2, wherein n is 2 or 3; wherein $R^1$ and $R^{11}$, independently, are hydrogen, methyl or ethyl; and $X^1$ and $X^{11}$, independently, are H or OR.

4. The composition defined in claim 3, wherein n is 2 or 3; wherein $R^2$ and $R^{12}$ are methyl; wherein $X^1$ and $X^{11}$ are H; and wherein $R^1$ and $R^{11}$ are methyl.

5. The composition defined in claim 1 wherein the total weight of sulfur is from about 0.01 weight percent to about 3 weight percent based upon the total weight of said diesel fuel.

6. The composition defined in claim 3 wherein the total weight of sulfur is from about 0.01 weight percent to about 3 weight percent based upon the total weight of said diesel fuel.

7. The composition defined in claim 4 wherein the total weight of sulfur is from about 0.01 weight percent to about 3 weight percent based upon the total weight of said diesel fuel.

8. The composition defined in claim 1 further comprising a nitrate cetane improver.

9. The composition defined in claim 2 further comprising a nitrate cetane improver.

10. The composition defined in claim 3 further comprising a nitrate cetane improver.

11. The composition defined in claim 4 further comprising a nitrate cetane improver, the amount of said nitrate cetane improver being from about 9% to about 91% by weight based upon the total weight of said nitrate cetane improver and said sulfur containing compound.

12. A fuel additive concentrate comprising: (A) one or more diesel fuel additives selected from the group consisting of a diesel fuel stabilizer, a corrosion inhibitor, a smoke supressant, and a non-sulfur containing cetane improver; and (B) a sulfur containing compound having the formula:

$$X^{11}-\overset{O}{\overset{\|}{C}}-\underset{\underset{R^{12}}{|}}{\overset{R^{11}}{\overset{|}{C}}}-(S)_n-\underset{\underset{R^2}{|}}{\overset{R^1}{\overset{|}{C}}}-\overset{O}{\overset{\|}{C}}-X^1$$

wherein n is an integer from 1 to 5, wherein $R^2$ and $R^{12}$ are hydrogen, methyl or ethyl, wherein $X^1$ and $X^{11}$, independently, are H, OR* wherein R* is an alkyl having from 1 to about 10 carbon atoms, or OH, and wherein $R^1$ and $R^{11}$, independently, are hydrogen, a saturated hydrocarbyl having from 1 to 8 carbon atoms, or $$\overset{O}{\overset{\|}{C}}-X^1.$$

13. The fuel additive concentrate defined in claim 12, wherein n is 2 or 3, wherein $R^2$ and $R^{12}$ are methyl, wherein $X^1$ and $X^{11}$ are H, and wherein $R^1$ and $R^{11}$ are methyl.

* * * * *